United States Patent [19]

Quigley

[11] 4,211,900

[45] Jul. 8, 1980

[54] SLIDE SWITCH WITH SHORTING CONTACT

[75] Inventor: Thomas J. Quigley, Farmville, Va.

[73] Assignee: Stackpole Components Company, Raleigh, N.C.

[21] Appl. No.: 967,169

[22] Filed: Dec. 7, 1978

[51] Int. Cl.[2] ..... H01H 15/02; H01H 9/00

[52] U.S. Cl. ..... 200/5 R; 200/16 D; 200/17 R

[58] Field of Search ..... 200/16 C, 16 D, 16 E, 200/16 F, 252, 329, 330, 243, 17 R, 18, 5 R

[56] References Cited

U.S. PATENT DOCUMENTS

| | | | |
|---|---|---|---|
| 3,784,765 | 1/1974 | Daly | 200/16 D X |
| 3,843,852 | 10/1974 | Lockard | 200/16 D |
| 3,965,311 | 6/1976 | Parolin | 200/17 R X |
| 4,042,795 | 8/1977 | Sykora | 200/16 D |

*Primary Examiner*—James R. Scott

*Attorney, Agent, or Firm*—Brown, Flick & Peckham

[57] ABSTRACT

Two parallel rows of three fixed electric contacts are mounted on an insulating base. An insulating slider movable lengthwise of the rows carries a pair of bridging contacts from a position in which each bridging contact bridges the adjoining middle fixed contact and either of the end contacts in the same row to a position bridging the same middle contact and the other end contact in that row. When the bridging contacts are moved into engagement with a pair of end contacts, the slider also moves a metal shorting contact into engagement with the other pair of end contacts, whereby those two contacts are electrically connected.

4 Claims, 4 Drawing Figures

SLIDE SWITCH WITH SHORTING CONTACT

OBJECTS OF THE INVENTION

It is among the objects of this invention to provide a slide switch in which two contacts are shorted when other contacts are placed in circuit.

BRIEF DESCRIPTION OF THE DRAWINGS

The preferred embodiment of the invention is illustrated in the accompanying drawings, in which.

Figure 1:
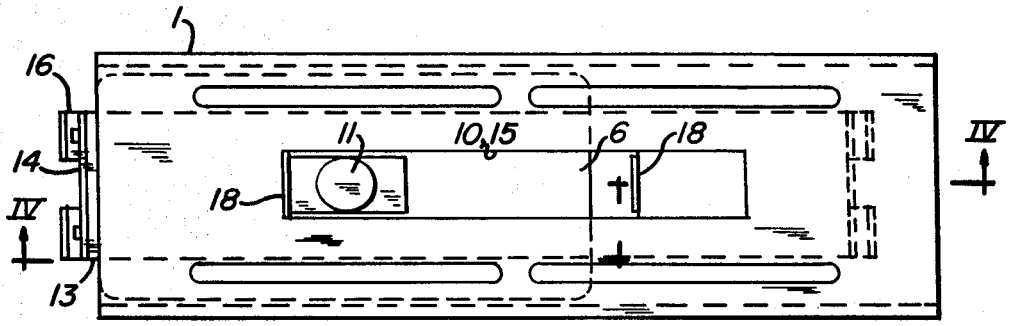
FIG. 1 is a top view.
Figure 2:
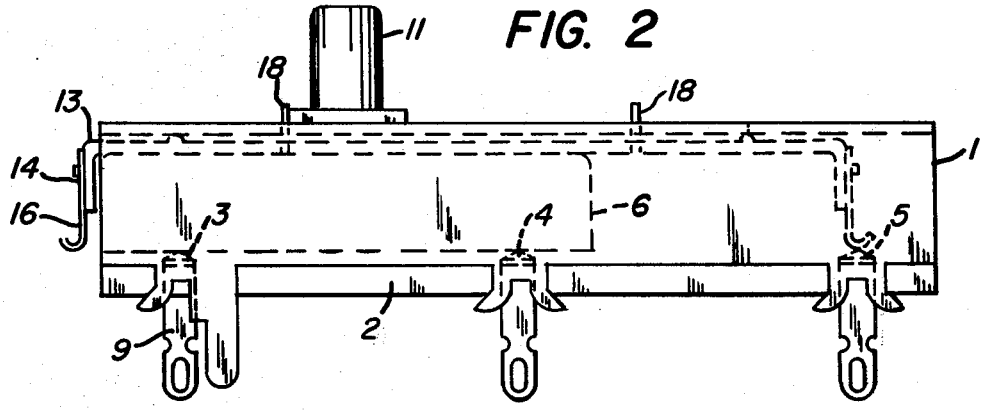
FIG. 2 is a side view.
Figure 3:
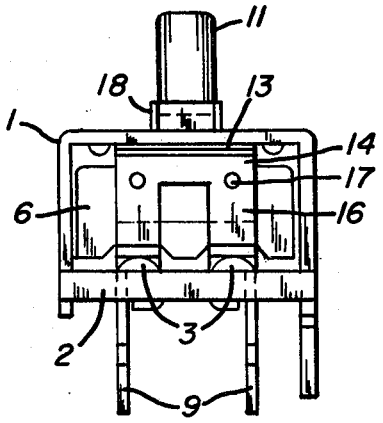
FIG. 3 is an end view.
Figure 4:
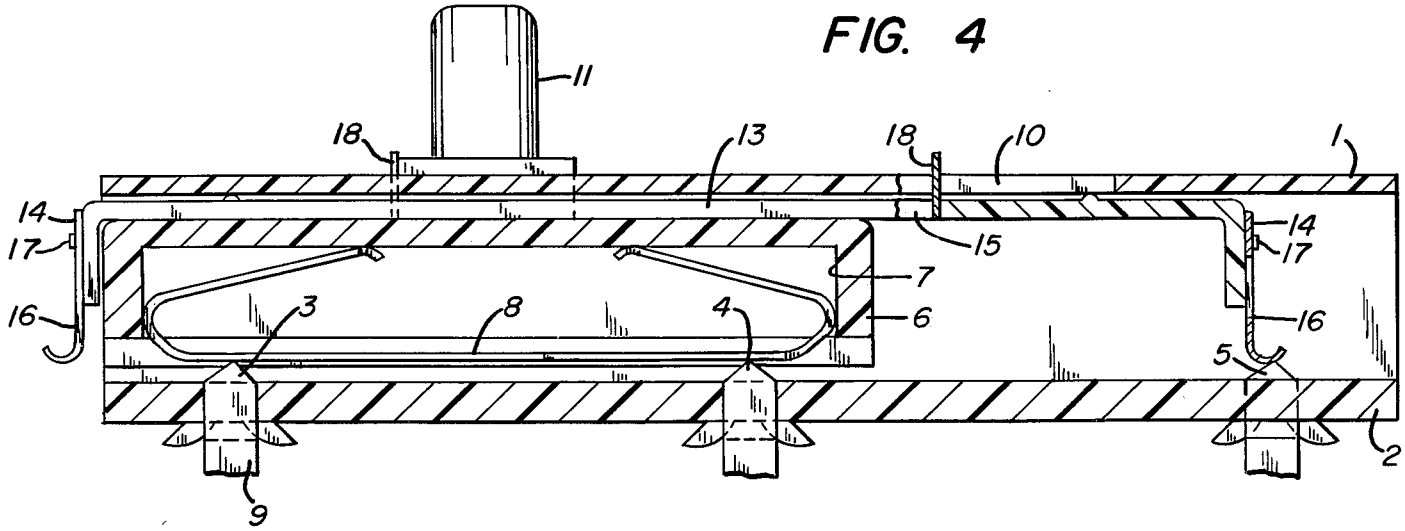
FIG. 4 is an enlarged longitudinal section taken on the line IV—IV of FIG. 1.

Referring to the drawings, an elongated switch case is formed from metal channel-shape housing 1, the bottom of which is closed by an insulating base 2 in the usual manner. Rigidly mounted on the base inside the case are two parallel rows of electric contacts, there being three contacts 3, 4 and 5 in each row spaced apart lengthwise of the base. Also inside the case there is a rectangular slider 6 made of insulating material, such as a plastic, and provided with two parallel recesses 7 extending lengthwise of the case and open at their bottoms. In each of these recesses there is a bridging contact 8 formed from a resilient metal strip having a straight central body portion, from the ends of which integral legs are inclined upwardly toward each other. The slider recesses are in such positions that when the slider is moved lengthwise of the case it will move the bridging contacts across the fixed contacts. In one extreme position of the slider the bridging contacts will bridge the middle fixed contacts 4 and the contacts at one end of the insulating base, such as contacts 3, as shown in FIG. 4, and in the other extreme position of the slider the two middle contacts and the other two end contacts 5 will be bridged by the sliding contacts. The six fixed contacts are connected with the desired electric circuits by means of terminals 9 extending through the base.

To permit the slider to be moved, the top of the case is provided with a longitudinal slot 10, through which a central button 11 on the slider extends.

It is a feature of this invention that the pair of fixed end contacts not engaged at the time by the bridging contacts can be electrically connected to short circuit them. Accordingly, shorting contact means is disposed in the case and is moved by the slider button into engagement with the pair of end contacts not engaged at the time by the bridging contacts. The shorting contact means preferably is composed of an insulating strip 13 and a metal contact 14 secured to each end of the strip. The insulating strip is disposed between the slider 6 and the top side of the metal housing 1, which the strip 13 engages. This strip 13 has a central longitudinal slot 15 in it directly below housing slot 10, with the slider button 11 extending through both slots. Each of the metal contacts 14 is bifurcated to provide two laterally spaced contact fingers 16 at each end of the strip. Each finger has a reversely bent lower end for engaging one of the fixed end contacts on the base member. Contacts 14 are secured to downwardly extending end portions of the insulating strip by projections 17 of the strip extending through holes in the contacts and rigidly mounted therein.

The slot 15 in the top of the insulating strip 13 is shorter than the housing slot 10, so that after the slider button has been moved a predetermined distance without moving the shorting contact means it will then engage the end of slot 15 and move the strip 13 and contacts 14 a short distance. This distance is just sufficient to pull the contact fingers 16, which were located at the opposite end of the case and were disposed outwardly beyond the fixed contacts at that end of the case, into engagement with those fixed contacts, such as contacts 3 in FIG. 4, to short circuit them. Simultaneously, the slider moves the bridging contacts 8, which are always in engagement with middle contacts 4, into engagement with the other pair of end contacts (contacts 5 in FIG. 4) to electrically connect them with the middle contacts 4. Reversing the movement of the slider the full distance will cause the other contact 14 to short the other pair of end contacts (contacts 5) while connecting the first pair of end contacts 3 into the circuits, as shown in FIG. 4.

Although the ends of the shorting contact slot 15 may form the abutments engaged by the slider button, it is preferred to provide a tab 18 at each end of the slot and extend it through the case slot to increase the area of the abutment engaged by the button.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A slide switch comprising an elongated case formed from a housing provided in one side with a longitudinal slot and also provided with an insulating base member, two parallel rows of fixed electric contacts inside the case spaced apart lengthwise of said base member and rigidly mounted thereon, there being three contacts in each row, an insulating slider inside the case provided with an actuating button extending through said slot for moving the slider back and forth lenthwise of the base member, a pair of bridging contacts movable by the slider along said rows of fixed contacts from a position in which each bridging contact bridges the adjoining middle fixed contact and one of the end fixed contacts in the same row to a position bridging the same middle contact and the other end contact in the same row, and shorting contact means in the case extending lengthwise of said housing between the housing and slider, said shorting contact means being longer than the slider and having a pair of abutments spaced lengthwise of the case, one of the abutments being engageable by the slider when it is moved in one direction, the other abutment being engageable by the slider when it is moved in the opposite direction, and the distance between said abutments being such that after the slider has been moved toward one end of the case a predetermined distance the slider will push one of said abutments in the same direction far enough to pull said shorting contact means into engagement with the two fixed contacts at the opposite end of the case when said bridging contacts engage the other two end contacts.

2. A slide switch according to claim 1, in which said shorting contact means are provided with a longitudinal slot registering with said housing slot, the shorting contact slot is shorter than the housing slot, said button extends through the shorting contact slot, and the ends of the shorting contact slot form said abutments.

3. A slide switch according to claim 1, in which said housing is metal, said shorting contact member includes an insulating strip disposed between said slider and the side of the housing opposite said base member, and a metal contact secured to each end of said strip and extending toward said base member, and said strip holding the contacts secured to it away from the housing.

4. A slide switch according to claim 3, in which said insulating strip has end portions extending toward said base member at opposite ends of the slider and said metal contacts are secured to said end portions.

* * * * *